United States Patent [19]

Sheetz

[11] 4,375,134

[45] Mar. 1, 1983

[54] EMERGENCY KIT

[76] Inventor: Floyd R. Sheetz, 403 Rutherford Rd., Harrisburg, Pa. 17107

[21] Appl. No.: 261,451

[22] Filed: May 7, 1981

[51] Int. Cl.[3] ..... G09F 21/04

[52] U.S. Cl. ..... 40/591; 116/173; 40/617; 40/610

[58] Field of Search ..... 40/590, 691, 603, 604, 40/591, 610; 116/173

[56] References Cited

U.S. PATENT DOCUMENTS

| | | | |
|---|---|---|---|
| 1,858,793 | 11/1958 | Palmer | 116/173 |
| 2,225,103 | 12/1940 | Einerman | 116/173 |
| 2,720,718 | 10/1955 | Vaniman | 40/603 |
| 2,887,983 | 5/1959 | Budd | 116/173 |
| 3,024,552 | 3/1962 | MacLea | 40/591 |
| 3,136,289 | 6/1964 | Johnson | 40/591 |
| 3,850,401 | 11/1974 | Snediker | 40/604 |
| 3,946,699 | 3/1976 | Mirshak | 116/173 |

*Primary Examiner*—Robert Peshock
*Assistant Examiner*—Wenceslao J. Contreras
*Attorney, Agent, or Firm*—Robert W. Carlson

[57] ABSTRACT

This invention relates to an emergency kit comprising a signaling device which is adapted to be supported on a window of a vehicle and which is collapsible for insertion into a container for storage in a convenient location in a vehicle.

2 Claims, 5 Drawing Figures

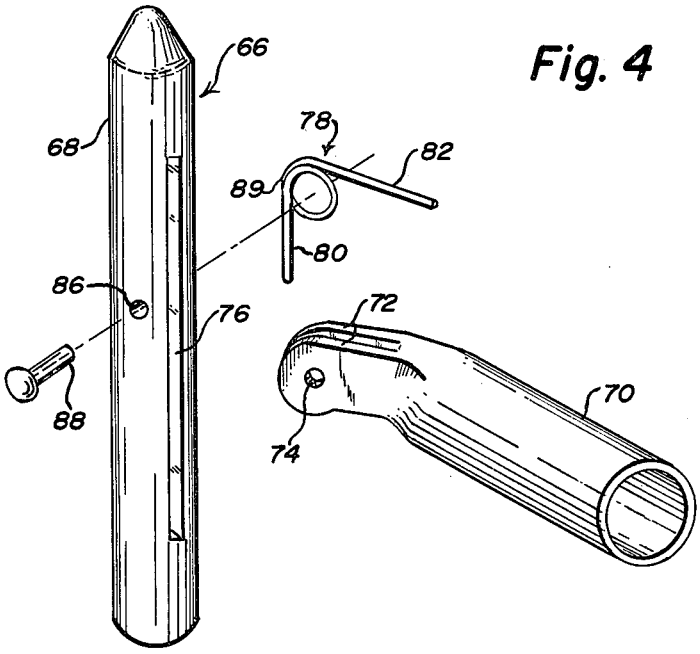
Fig. 4
Fig. 5
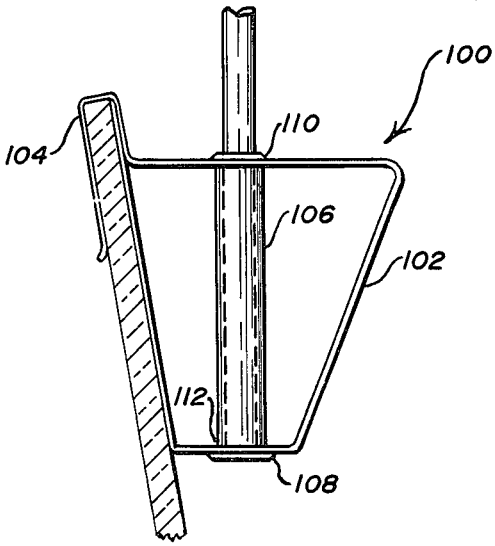

EMERGENCY KIT

BACKGROUND OF INVENTION

At times the vehicle operator will experience mechanical problems on our interstate or toll highways and has no way to summon help. Most often, the operator will raise the hood of the vehicle or tie a rag to the radio antenna. This requires the operator to get out of the vehicle, thus exposing himself or herself to the danger of onrushing vehicles.

The present invention provides a signaling device which is designed to be attached to the window of the vehicle on the right or left side without the need for any occupant to get out of the vehicle.

Further the flag is designed to be collapsible so that it may be inserted into a container for storage under the front seat, in the glove compartment, or any other convenient location in the automobile.

PRIOR ART

The broad concept of providing a signaling device for attachment to the window of a vehicle is not novel as evidenced by the following patents:

U.S. Pat. No. 2,855,890—Sprenger et al.
U.S. Pat. No. 3,239,957—Snediker
U.S. Pat. No. 3,715,821—Hawes
U.S. Pat. No. 3,775,887—Precourt
U.S. Pat. No. 4,014,557—Schulein
U.S. Pat. No. 4,091,553—Glennie Of these patents, the patent to Precourt, U.S. Pat. No. 3,775,887 does show a collapsible signaling device which may be folded into a small portable package. The present invention is very different from the prior art devices.

An object of this invention is to provide a signaling device which may be placed on the exterior of a vehicle without requiring an occupant of the vehicle to exit from the vehicle.

Another object of this invention is to provide a signaling device which is collapsible for convenient storage.

A further object of the invention is to provide a collapsible signaling device which is quickly and easily assembled into operative condition.

These and other objects of this invention will become readily apparent from the following description and the attached drawings in which FIG. 1 is a perspective view of the signaling device mounted on a vehicle;

FIG. 4 is a perspective view of a modification of the hinge means with its various components disassembled; and FIG. 5 is a side elevational view of a modification of the base member mounted on a window, shown in partial section.

Figure 1:
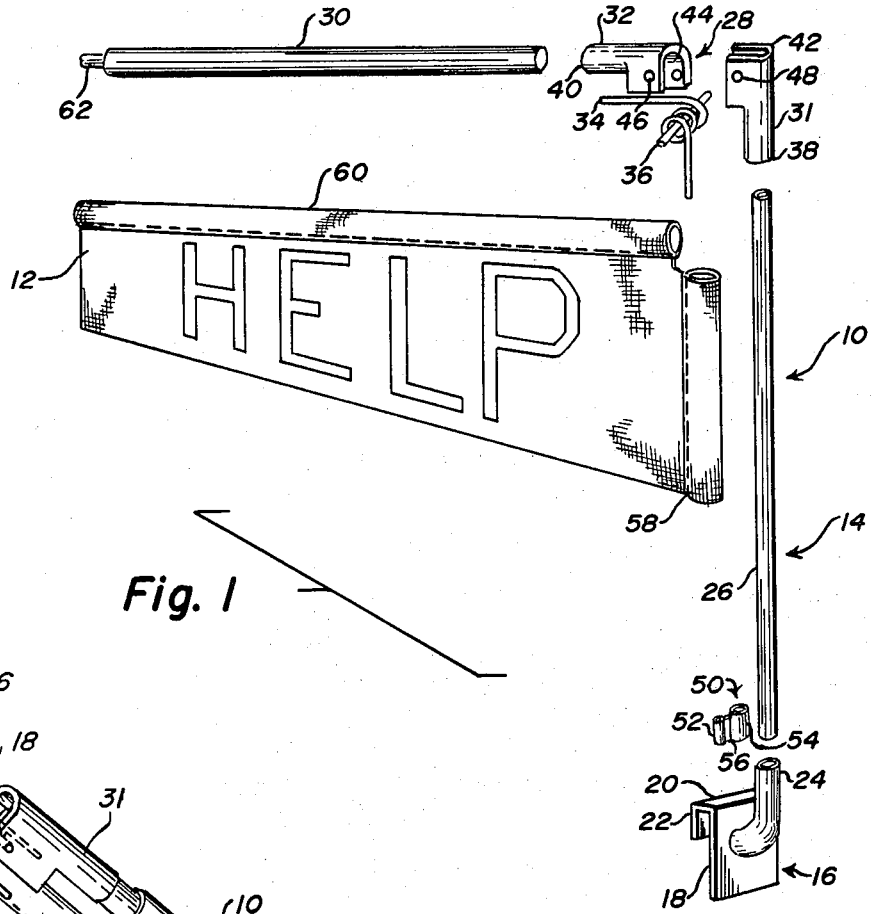
Figure 2:
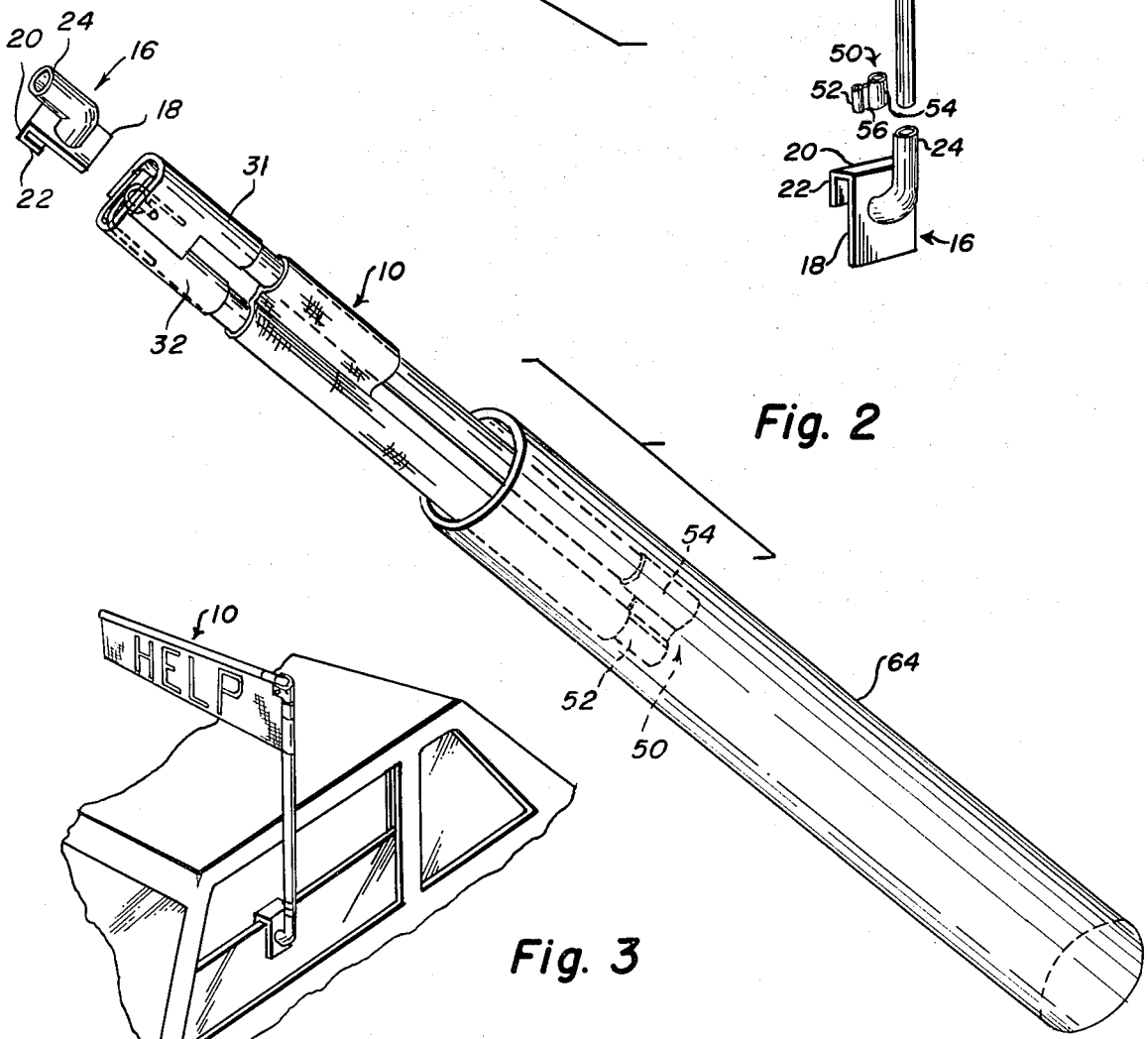
FIG. 2 is a plan view of the signaling device with its various components disassembled.

Referring now more specifically to the details of the invention, the signaling device 10 comprises a flag 12 made of suitable flexible material such as cloth or plastic with indicia thereon such as the word "Help" and a supporting frame 14.

The frame 14 includes a base member 16 which is J-shaped in cross section. The long leg 18 is adapted to rest against the outer surface of a vehicular window, the bight 20 extends over the top of the window and the short leg 22 rests against the inner surface of the window. Rigidly secured to the leg 18 of the base member 16 is a tubular elbow 24 which extends outwardly therefrom and terminates in a plane parallel to plane of the leg 18.

A first tube or rod 26 is inserted into the open end of the elbow 24 and frictionally held therein. The member 26 may be either a tube or a solid rod; however, for purposes of saving weight, it is illustrated as being tubular.

A hinge assembly 28 is adapted to be mounted on the end of the tube 26 and is adapted to support a second tube 30 substantially perpendicular to the first tube 26.

The hinge assembly 28 comprises a pair of legs 31 and 32 which are identical in configuation, a torsion spring 34, and a hinge pin 36. The legs 31 and 32 are formed with tubular portions 38 and 40 and open channel portions 42 and 44. The walls of the open channel portions are provided with a pair of aligned holes 46 and 48.

The open channel portions 42 of the leg 31 receives the open channel portion 44 of the leg 32 with the hinge pin 36 extending through the holes 46 and 48. The walls of the channel portions are sufficiently flexible so that they may be engaged in the manner described. The torsion spring 34 is supported on the hinge pin 36 with the ends thereof bearing on the legs 31 and 32 to maintain them in an angular relation of approximately 90°.

A latching member 50, the function of which will be described in detail below, comprises a pair of tubular members 52 and 54 joined together by a web 56 and the tubular member 52 is adapted to be slidably supported on the first tube 26.

From the foregoing description it is readily apparent that the various elements of the present invention may be easily and inexpensively manufactured. The signaling device is assembled by first inserting the tube 26 into the elbow 24. The tubular member 52 of the latching member 50 is then slid over the tube 26. A sleeve 58 on the flag 12 is thereafter slid onto the tube 26.

The hinge assembly is secured to the tube 26 by sliding the tubular portion 38 over the end of the tube 26. The second tube 30 is then inserted through the sleeve 60 on the flag 12 and inserted into the tubular portion 40. The signaling device is now completely assembled with the flag 12 supported in a visual condition. The joints between the tubular members and the hinge assembly and the base member are secured by frictional fits. In some instances it may be desired to use adhesive or fusion in the joints depending on the materials used.

Figure 3:
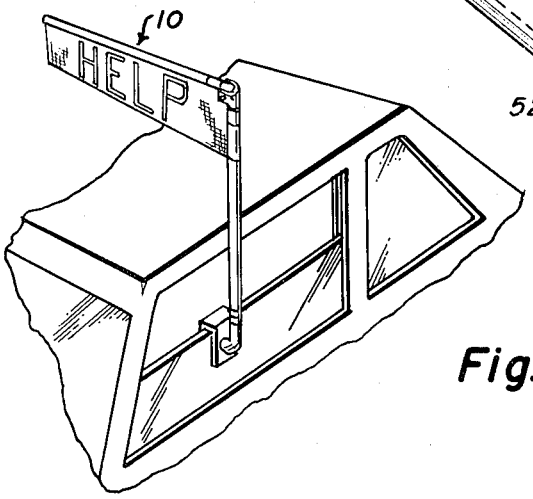
FIG. 3 is a perspective view of the signaling device in its collapsed condition and partially inserted into the container.

When it is desired to collapse the signaling device for storage, the tube 30 is swung down to a position adjacent the tube 26 as shown in FIG. 3. The latching member 50 resting on the elbow 24 is then moved upwardly until the tubular member 54 engages a tab 62 on the free end of the tube 30. The latching member 50 will thus hold the signaling device in its collapsed condition. In this condition the signaling device may then be inserted into the container 64 for storage.

When it is necessary to use the device, it is necessary only to remove the device from the container 64 and move the latching member 50 downwardly on the tube 26 until it releases the tab 58. The spring 34 will immediately urge the tube 30 to a position shown in FIG. 1 thus fully exposing the flag 12. A window is then rolled down sufficiently to enable the device to be mounted thereon as described earlier and thereafter the window is rolled upwardly to lock the signaling device in position.

In the modifications illustrated in FIGS. 4 and 5, the only changes are in the hinge assembly 28 and in the base member 16. The remaining parts therefore will be referred to with a prime of the original numerals without further description.

The modified hinge assembly 66 comprises a tube 68 adapted to slide onto the member 26'. A tubular element 70 is adapted to telescopically receive the member 30' at one end and is provided with a pair of ears 72 at its other end.

The ears 72 are provided with a pair of aligned openings 74 and are adapted to be inserted into the slot 76 in the tubular element 68.

The hinge assembly 66 is assembled by inserting a spring 78 into the slot 76 with one leg 80 extending downwardly inside the tube 68 and the other leg 82 extending outwardly through the slot 76 at an angle of 90° relative to the tube 68. The ears 72 are inserted into the slot 76, one each side of the coil 84 of the spring 78. The openings 74 are aligned with the center of the coil 84 and a pair of openings 86 in the tube 68. A pin 88 is inserted through the openings 86, 74 and the center of the coil 84 to hold the hinge assembly in its assembled condition. In this arrangement, the member 30' is held in a position substantially perpendicular to the member 26'.

The modified base member 100 comprises of single strap 102 of material formed into the configuration of an inverted frusto pyramid with one end of the strap 102 formed into an inverted U shape 104 so as to engage the window of a vehicle.

A cylindrical member 106 having a closed end 108 is secured in the base member 100 through a pair of aligned openings 110 and 112 in any suitable manner. The cylindrical member slidably receives the member 26' as illustrated in FIG. 3.

The modified signaling device is collapsed in the same manner as described before.

I claim:

1. An emergency kit comprising a container and a signaling device adapted to be stored in said container, said signaling device being adapted to be completely removed from said container so that it may be assembled into operative condition, said signaling device comprising a first tubular member, window bracket means adapted to be removably mounted on one end of said first tubular member, latch means comprising a pair of parallel tubes, one of said tubes being slidably mounted on said first tubular member, a second tubular member having a tab on one end thereof, hinge means connecting said first tubular member with said second tubular member, the second tube of said latch means adapted to receive said tab on said second tubular member to hold said signaling device in collapsed position, a spring in said hinge means which biases said second tubular member to a position substantially perpendicular to said first tubular member when said latch means is slid along said first tubular member, and a flag supported on said tubular members.

2. An emergency kit as set forth in claim 1 wherein said base member is in the form of an inverted J so as to be removably supported on the edge of a window.

* * * * *